US010494904B2

(12) United States Patent
Frosell et al.

(10) Patent No.: US 10,494,904 B2
(45) Date of Patent: Dec. 3, 2019

(54) WATER FRONT SENSING FOR ELECTRONIC INFLOW CONTROL DEVICE

(71) Applicant: Halliburton Energy Services, Inc., Houston, TX (US)

(72) Inventors: Thomas Jules Frosell, Irving, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 119 days.

(21) Appl. No.: 15/555,008

(22) PCT Filed: Apr. 29, 2016

(86) PCT No.: PCT/US2016/030168

§ 371 (c)(1),
(2) Date: Aug. 31, 2017

(87) PCT Pub. No.: WO2017/189000

PCT Pub. Date: Nov. 2, 2017

(65) Prior Publication Data

US 2018/0106137 A1 Apr. 19, 2018

(51) Int. Cl.

| | |
|---|---|
| ***E21B 34/14*** | (2006.01) |
| ***E21B 43/12*** | (2006.01) |
| ***E21B 47/12*** | (2012.01) |
| *E21B 43/32* | (2006.01) |

(52) U.S. Cl.

CPC ..... *E21B 43/12* (2013.01); *E21B 34/14* (2013.01); *E21B 47/12* (2013.01); *E21B 43/32* (2013.01)

(58) Field of Classification Search

CPC ..... E21B 34/14; E21B 43/12; E21B 43/32; E21B 47/12

See application file for complete search history.

(56) References Cited

U.S. PATENT DOCUMENTS 8,499,828 B2 * 8/2013 Chen ..... E21B 47/122 166/250.01
8,550,160 B2 10/2013 Proett
8,988,178 B2 3/2015 Deville et al.

(Continued)

FOREIGN PATENT DOCUMENTS

EP 2677116 A1 12/2013

OTHER PUBLICATIONS

Patent Cooperation Treaty, International Search Report and Written Opinion, PCT Appln. PCT/US16/30166, dated Feb. 23, 2017.

*Primary Examiner* — Daniel P Stephenson
(74) *Attorney, Agent, or Firm* — McGuireWoods LLP

(57) ABSTRACT

Included are well systems and methods for use in subterranean formations. An example well system comprises a water front sensor operable to sense a water front, wherein the water front sensor comprises a water front sensor signal transmitter and a water front sensor signal receiver. The example well system further comprises an electronic inflow control device, wherein the electronic inflow control device comprises a flow regulator in fluidic communication with an inlet of the electronic inflow control device and adjustable to provide a flow resistance to a fluid flowing through the electronic inflow control device, and a controller configured to actuate the flow regulator to change the flow resistance through the electronic inflow control device.

18 Claims, 9 Drawing Sheets

(56) References Cited

U.S. PATENT DOCUMENTS

| | | | | |
|---|---|---|---|---|
| 9,097,820 | B2 | 8/2015 | Rasheed | |
| 9,587,485 | B2 * | 3/2017 | Jannin | E21B 49/087 |
| 2003/0066652 | A1 * | 4/2003 | Stegemeier | E21B 43/12 166/373 |
| 2004/0262011 | A1 * | 12/2004 | Huckabee | E21B 43/08 166/369 |
| 2005/0051323 | A1 | 3/2005 | Fripp et al. | |
| 2008/0066961 | A1 * | 3/2008 | Aivalis | E21B 4/02 175/50 |
| 2009/0101354 | A1 | 4/2009 | Holmes et al. | |
| 2009/0188665 | A1 | 7/2009 | Tubel et al. | |
| 2011/0079388 | A1 | 4/2011 | Cox | |
| 2011/0139443 | A1 * | 6/2011 | Chen | E21B 47/102 166/250.01 |
| 2018/0106137 | A1 * | 4/2018 | Frosell | E21B 34/14 |
| 2018/0223648 | A1 * | 8/2018 | Wilson | G01V 3/30 |
| 2019/0055813 | A1 * | 2/2019 | Greci | E21B 43/12 |

* cited by examiner

800

WATER FRONT SENSING FOR ELECTRONIC INFLOW CONTROL DEVICE

TECHNICAL FIELD

The present disclosure relates to downhole tools for use in a wellbore environment and more particularly to adjusting flow resistance in an electronic inflow control device in response to sensing a water front.

BACKGROUND

After a wellbore has been formed, various downhole tools may be inserted into the wellbore to extract the natural resources such as hydrocarbons or water from the wellbore, to inject fluids into the wellbore, and/or to maintain the wellbore. At various times during production, injection, and/or maintenance operations, it may be necessary to regulate fluid flow into or out of various portions of the wellbore or various portions of the downhole tools used in the wellbore.

An inflow control device may be used to regulate unequal inflow along the length of a well path. If unregulated water or gas coning may occur at areas of high drawdown pressure, for example the heel of a horizontal wellbore, inflow control devices placed along the length of the completion may be used to regulate the unequal pressure.

Some examples of inflow control devices may also be used to restrict the production of water by regulating the inflow of water into the completion. These inflow control devices may be used to improve recovery and extend the life of the well operation.

BRIEF DESCRIPTION OF THE DRAWINGS

Illustrative examples of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different examples may be implemented.

DETAILED DESCRIPTION

The present disclosure relates to downhole tools for use in a wellbore environment and more particularly to adjusting flow resistance in an electronic inflow control device in response to sensing a water front. A downhole assembly may include an electronic inflow control device to regulate the flow of fluids between the wellbore and the downhole assembly. A flow regulator of the electronic inflow control device may be actuated to increase or decrease the rate of fluid flow through the electronic inflow control device in response to a signal received from a signaling device communicatively coupled to a water front sensor. The water front sensor may be positioned on or inside the tubing of the downhole assembly, or on or inside the electronic inflow control device coupled to the tubing of the downhole assembly. For example, the sensor may be positioned in the wellbore in a manner sufficient to sense the presence or approach of a water front. If a water front is sensed, the sensor may induce a signaling device to signal the electronic inflow control device to adjust the flow regulator of the electronic inflow control device such that the flow resistance of the inflow of the electronic inflow control device is altered. Embodiments of the present disclosure and its advantages may be understood by referring to FIGS. 1 through 11, where like numbers are used to indicate like and corresponding parts.

Figure 1:
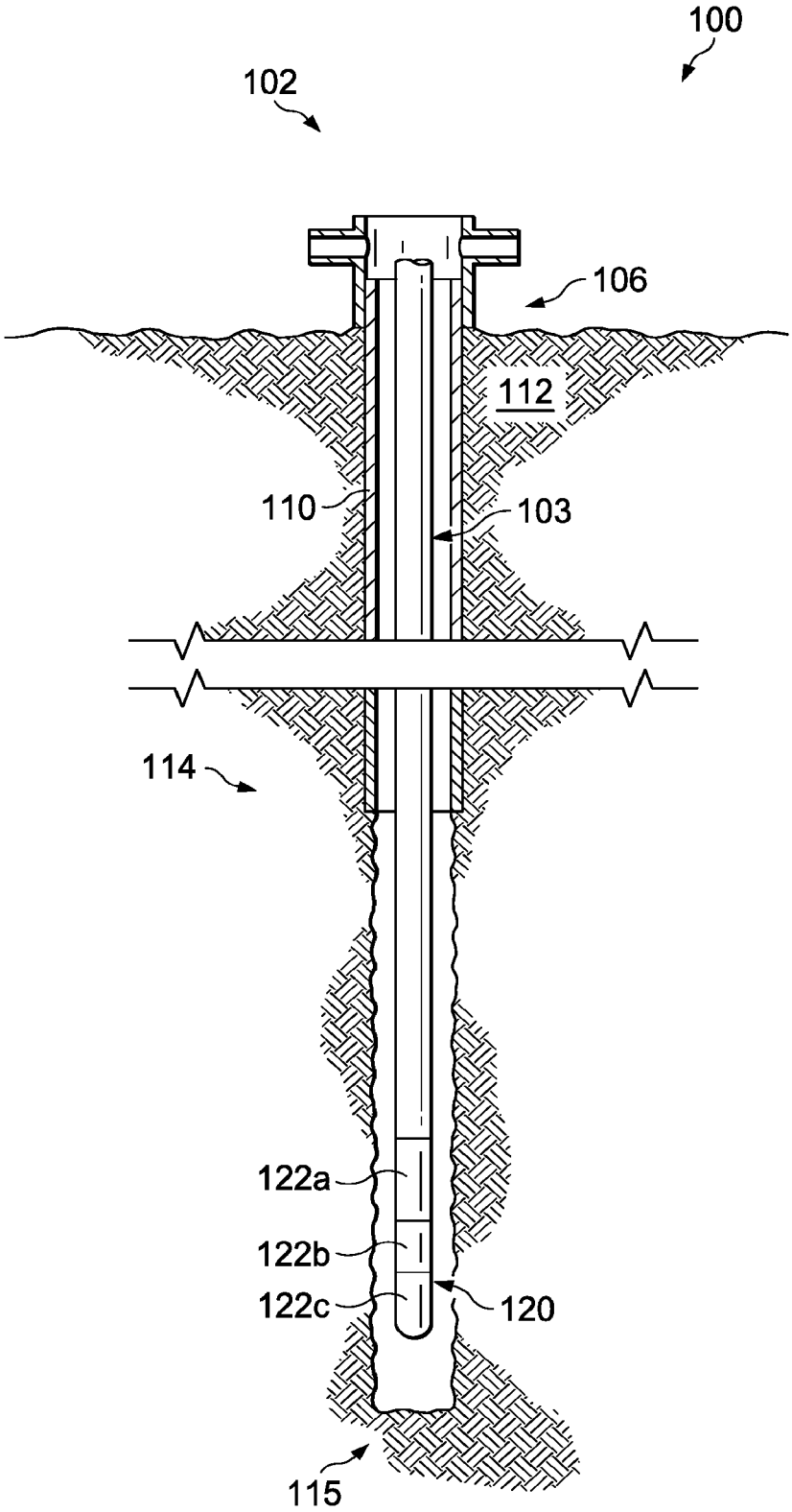
FIG. 1 is an elevation view of a well-production system.

FIG. 1 is an elevation view of a well-production system 100. Well-production system 100 may be located at well site 102. Various types of equipment such as a rotary table, drilling fluid or production fluid pumps, tubulars, casing equipment, drilling fluid tanks (not expressly shown), and other drilling or production equipment may be located at well site 102. Well-production system 100 may include wellhead 106. The wellhead 106 may include various characteristics and features associated with a well-production system 100 including a Christmas tree, isolation equipment, choke equipment, tubing hangers, etc. Although an onshore well-production system 100 is disclosed, it is to be understood that the teachings of the present disclosure may be used at any offshore well sites 102 and with any related offshore equipment including surface and subsea wellheads 106.

Well-production system 100 may also include production string 103, which may be used to produce hydrocarbons such as oil and gas and other natural resources such as water from formation 112 via wellbore 114. Production string 103 may also be used to inject hydrocarbons such as oil and gas and other natural resources such as water into formation 112 via wellbore 114. Although wellbore 114 is drawn with a substantially vertical section showing (e.g., substantially perpendicular to the surface), it should be understood that the wellbore 114 may follow any given trajectory obtainable, including one or more vertical and one or more non-vertical sections, by virtue of having been drilled using modern directional drilling techniques.

Casing string 110 is optionally provided in the instance of cased-hole completions. The casing string 110 may extend to a desired depth of the wellbore 114, and held in place by cement, which may be injected in an annulus between casing string 110 and the sidewalls of wellbore 114. Casing string 110 may provide radial support to wellbore 114 and may seal against unwanted communication of fluids between wellbore 114 and surrounding formation 112. Casing string 110 may extend from wellhead 106 to a selected downhole location within wellbore 114. Portions of wellbore 114 that do not include casing string 110 may be referred to as open hole. In some cases, no casing string 110 is required, which may be referred to as open-hole completions.

The terms uphole and downhole may be used to refer to the location of various components relative to the bottom (i.e. lower) end 115 of wellbore 114 shown in FIG. 1. For example, a first component described as uphole from a second component may be further away from the lower end 115 of wellbore 114 than the second component. Similarly, a first component described as being downhole from a second component may be located closer to the lower end 115 of wellbore 114 than the second component.

Well-production system 100 may also include production assembly 120 coupled to production string 103. Production assembly 120 may be used to perform operations relating to completion of wellbore 114, production of hydrocarbons and other natural resources from formation 112 via wellbore 114, injection of hydrocarbons and other natural resources into formation 112 via wellbore 114, and/or maintenance of wellbore 114. Production assembly 120 may be located at the lower end 115 of wellbore 114 or at a point uphole from the lower end 115 of wellbore 114. Production assembly 120 may be formed from a wide variety of components configured to perform these operations. For example, components 122*a*, 122*b*, and 122*c* of production assembly 120 may include, but are not limited to, screens, passive inflow control devices, electronic inflow control devices, slotted tubing, packers, valves, sensors, and actuators. The number and types of components 122 included in production assembly 120 may depend on the type of wellbore, the operations being performed in the wellbore, and anticipated wellbore conditions.

Fluids may be extracted from or injected into wellbore 114 via production assembly 120 and production string 103. For example, production fluids, including hydrocarbons, water, sediment, and other materials or substances found in formation 112 may flow from formation 112 into wellbore 114 through the sidewalls of open hole portions of wellbore 114. The production fluids may circulate in wellbore 114 before being extracted from wellbore 114 via production assembly 120 and production string 103. Additionally, injection fluids, including hydrocarbons, water, and other materials or substances, may be injected into wellbore 114 and formation 112 via production string 103 and production assembly 120. Production assembly 120 may include a screen (e.g., screen 202, as illustrated in FIG. 2) to filter sediment from fluids flowing between wellbore 114 and production assembly 120.

Production assembly 120 may also include an inflow control device to regulate the flow of fluids between wellbore 114 and production assembly 120. The flow resistance provided by the inflow control device may be adjustable, for example, by using an electronic inflow control device, in order to increase or decrease the rate of fluid flow through the electronic inflow control device. Production assembly 120 may be in communication with a signaling device (e.g., signaling device 218 as illustrated in FIG. 2) that signals production assembly 120 or the electronic inflow control device to increase or decrease the flow resistance provided by the electronic inflow control device. For example, the signaling device may be located at well site 102, within the wellbore 114 at the location of the production assembly 120, within wellbore 114 at a location different from the location of production assembly 120, within the wellbore 114 at a water front sensor, within the wellbore 114 and positioned about the production assembly 120 but at a location different from a water front sensor, or within a lateral wellbore.

Figure 2:
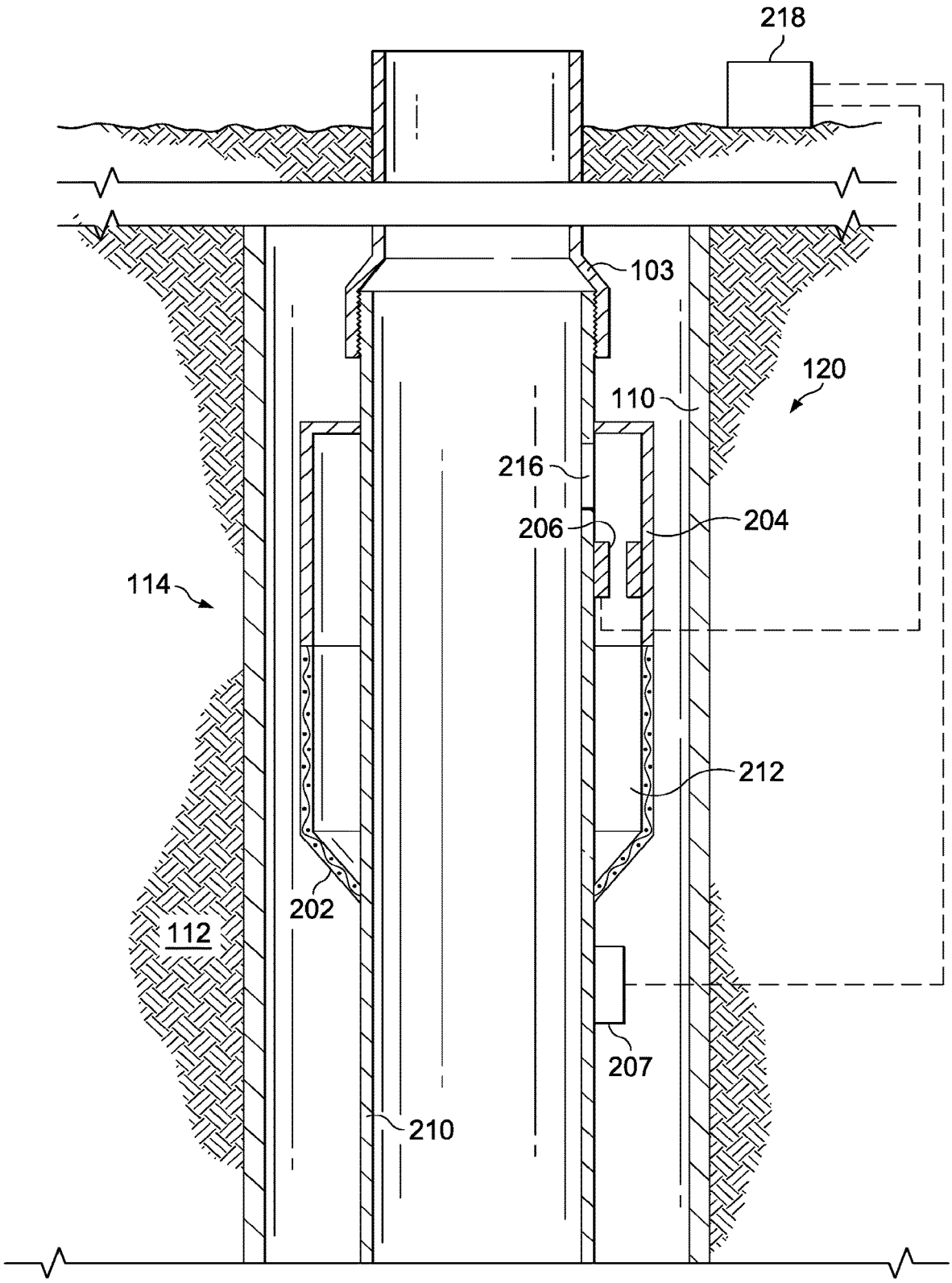
FIG. 2 is a cross-sectional view of a downhole assembly including an electronic inflow control device and a water front sensor.

FIG. 2 is a cross-sectional view of a production assembly 120 including an electronic flow control device 206. Production fluids circulating in the wellbore 114 may flow through production assembly 120 into production string 103. Similarly, injection fluids circulating in production string 103 may flow through production assembly 120 into the wellbore 114. Production assembly 120 may be located downhole from production string 103 and may be coupled to production string 103 via tubing 210. Production assembly 120 may be coupled to production string 103 by a threaded joint. Alternatively, a different coupling mechanism may be employed. The coupling of production assembly 120 and production string 103 may provide a fluid and pressure tight seal.

Production assembly 120 may include screen 202 and shroud 204. Both screen 202 and shroud 204 may be coupled to and positioned around the circumference of tubing 210 such that annulus 212 is formed between the inner surfaces of screen 202 and shroud 204 and the outer surface of tubing 210. Screen 202 may be configured to filter sediment from fluids as they flow through screen 202. Screen 202 may include, but is not limited to, a sand screen, a gravel filter, a mesh, or slotted tubing.

Production assembly 120 may also include an electronic inflow control device 206 positioned within annulus 212 between shroud 204 and tubing 210. Electronic inflow control device 206 may engage with shroud 204 and tubing 210 to prevent fluids circulating in annulus 212 from flowing between electronic inflow control device 206 and tubing 210 or shroud 204. For example, electronic inflow control device 206 may engage with the inner surface of shroud 204 to form a fluid and pressure tight seal and may engage with the outer surface of tubing 210 to form a fluid and pressure tight seal. Fluids circulating in the wellbore 114 may enter production assembly 120 by flowing through screen 202 into annulus 212. From annulus 212, fluids may flow through electronic inflow control device 206 and into tubing 210 through opening 216 formed in the sidewall of tubing 210. Similarly, fluids circulating in production string 103 may enter the wellbore 114 by flowing through opening 216 formed in the sidewall of tubing 210 and into annulus 212. From annulus 212, fluids may flow through electronic inflow control device 206, through screen 202, and into the wellbore 114.

Electronic inflow control device 206 may be utilized to regulate fluid flow into production assembly 120 from wellbore 114. Alternatively, electronic inflow control device 206 may be utilized to regulate fluid flow out of production assembly 120 into the wellbore 114 if desired. The rate of fluid flow through electronic inflow control device 206 may be regulated by adjusting the flow resistance provided by electronic inflow control device 206 using a flow regulator, for example, flow regulator 304 as illustrated on FIG. 3. Electronic inflow control device 206 may be coupled to a water front sensor 207. Water front sensor 207 may allow the electronic inflow control device 206 to adjust the rate of fluid flow resistance in anticipation of a volume of water being drawn into the wellbore 114 by the drawdown pressure, which is the pressure differential between the wellbore 114 and the formation 112. Water front sensor 207 may sense the water front of the approaching volume of water and may transmit this information to a signaling device 218.

Electronic inflow control device 206 may be in communication with a signaling device 218 that signals electronic inflow control device 206 to increase or decrease the flow resistance provided by electronic inflow control device 206.

The signaling device 218 may be located at a well site (e.g., well site 102 illustrated in FIG. 1), within the wellbore 114 at the location of the production assembly 120, within wellbore 114 at a location different from the location of the electronic inflow control device 206, within the wellbore 114 at the water front sensor 207, within the wellbore 114 and positioned about the production assembly 120 but at a location different from the water front sensor 207, or within a lateral wellbore (not illustrated). An increase in the flow resistance provided by electronic inflow control device 206 may result in a corresponding decrease in the rate of fluid flow through electronic inflow control device 206, while a decrease in the flow resistance provided by electronic inflow control device 206 may result in a corresponding increase in the rate of fluid flow through electronic inflow control device 206. The signaling device 218 may be used to induce the adjustment of the flow resistance for any desired reason. For example, the signaling device 218 may be used to induce the adjustment of the flow resistance in response to the water front sensor 207 detecting the approach of a water front from a surrounding formation, for example formation 112. The signaling device 218 may also induce the adjustment of the flow resistance in a manner similar to other inflow control devices, for example, if water and/or gas are detected within the electronic inflow control device 206, the signaling device 218 may transmit a signal to the electronic inflow control device 206 to increase fluid flow resistance. Alternatively, or in addition to, the electronic inflow control device 206 may function as a passive inflow control device and autonomously adjust the flow resistance if water and/or gas are detected with the electronic inflow control device 206.

Although production assembly 120 is illustrated as comprising a single electronic inflow control device 206, multiple electronic inflow control devices 206 may be utilized to regulate fluid flow into production assembly 120 from a wellbore 114. For example, electronic inflow control devices 206 may be located at multiple locations within the wellbore 114 in order to regulate fluid flow into the production assembly 120 or any other completions equipment out of various parts of wellbore 114. Additionally, electronic inflow control devices 206 may be used in conjunction with non-electronic inflow control devices, e.g., passive inflow control devices, which may not possess electronics and/or moving parts. Any number and any combination of electronic inflow control devices 206 and non-electronic inflow control devices may be used as desired. In some examples, packers or other isolation devices may be placed between the multiple electronic inflow control devices 206 as desired.

Figure 3:
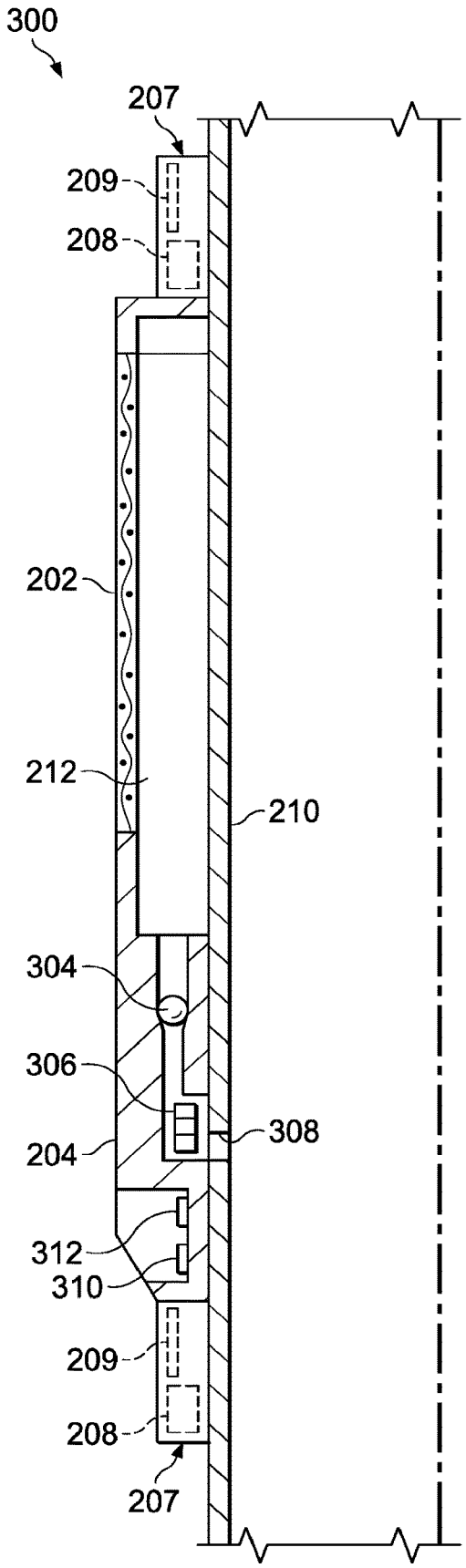
FIG. 3 is a cross-sectional view of an electronic inflow control device and a water front sensor.
Figure 4:
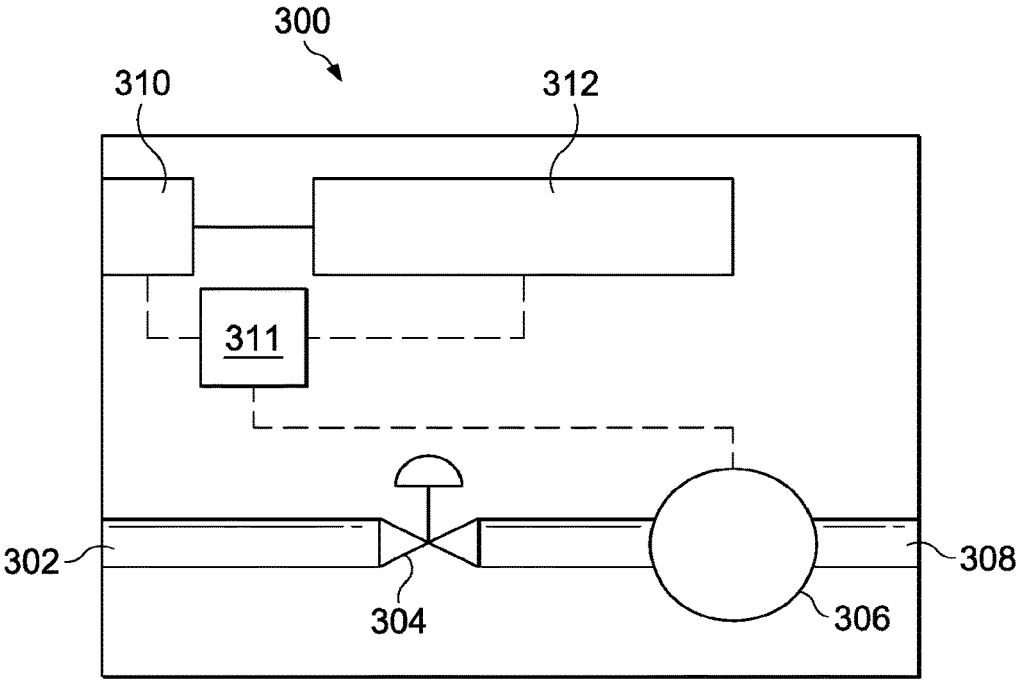
FIG. 4 is a schematic of an electronic inflow control device including a flow regulator in series with a generator.

Now referring to FIGS. 3 and 4; FIG. 3 is a cross-sectional view of an electronic inflow control device 300 positioned within annulus 212 between shroud 204 and tubing 210. FIG. 4 is a schematic of an electronic inflow control device 300 including a flow regulator 304 in series with a generator 306. Wellbore fluids, including water and hydrocarbons, may flow through screen 202 and into inlet 302 of the electronic inflow control device 300. Flow regulator 304 may be used to adjust the flow resistance of fluids through electronic inflow control device 300. Water front sensor 207, depicted on FIG. 3 as being positioned on the outside of tubing 210 and adjacent to the electronic inflow control device 300, may be used to detect the presence of an approaching water front and to convey this information to a signaling device (e.g., signaling device 218 as illustrated in FIG. 2) which may be used to signal receiver 310. In response to the signals received by receiver 310, controller 312 may adjust the flow resistance provided by flow regulator 304 as directed by the signal received by receiver 310 from the signaling device. For example, the signaling device may signal receiver 310 to induce controller 310 to adjust the resistance of flow regulator 304 based on readings transmitted to the signaling device from the water front sensor 207. Alternatively, the signaling device may signal receiver 310 to induce controller 310 to stop adjusting the resistance of flow regulator 304 based on readings transmitted to the signaling device from the water front sensor 207. As such, the signaling device may be used to induce adjustment of the resistance of the electronic inflow control device 300 in any desired manner, including in response to readings from a water front sensor 207.

Water front sensor 207 may be any sensor operable to detect an approaching water front. Examples of water front sensor 207 include any sensor capable of detecting a water front in the annular space between the tubing (e.g., tubing 210, as illustrated in FIG. 2) and the wall of the wellbore, the near-wellbore region, and/or the deep-wellbore region. The wall of the wellbore defining the annular space may be cased or open as desired. For the purposes of this disclosure, as defined herein, the "near-wellbore region" refers to the area consisting of a depth of five feet into the formation from the face of the formation. For the purposes of this disclosure, as defined herein, the "deep-wellbore region" refers to the area consisting of a depth greater than five feet into the formation from the face of the formation. For example, the water front sensor 207 may be able to detect a water front within the annular space between the tubing and the wall of the wellbore, in the near-wellbore region, and thirty feet into the deep-wellbore region. It is to be understood that the range of detection of a water front is a limitation of the range of the water front sensor 207. No limitation as to the range of water front sensing is claimed herein. In examples, water front sensor 207 may detect a water front produced from any source. For example, the water front may be produced from an injection well, hydraulic fracturing, or the water front may be from a naturally occurring water source present in the formation prior to the time the wellbore was drilled.

Examples of water front sensor 207 may include electromagnetic sensors which may be used to measure a change in the resistivity and/or conductivity of the formation. Examples of electromagnetic sensors include any sensor capable of taking an electromagnetic field measurement, including broadband measurements and/or frequency selective measurements. The electromagnetic sensors may comprise any sensor capable of transmitting electromagnetic waves and measuring the total electromagnetic field including any secondary field generated from the interaction of the transmitted electromagnetic waves through the matter occupying the physical space through which the electromagnetic waves were transmitted. The electromagnetic field measurement, discussed above, may comprise the relative change in the electromagnetic field between two water front sensor signal receivers 209, discussed below. The electromagnetic field measurement may comprise the relative change in the electromagnetic field between the transmission and reception of electromagnetic waves. The electromagnetic field measurement may comprise the relative change in the electromagnetic field between the same water front sensor signal receiver 209 at different time periods. The electromagnetic field measurement may comprise the relative change in the electromagnetic field between the same water front sensor signal receiver 209 at different frequencies. The relative change may be the change in amplitude or the change in phase.

In alternative examples, the water front sensor 207 may comprise a neutron logging sensor which may be used to measure the neutron cloud surrounding the water front sensor 207. The neutron logging sensor may comprise any sensor capable of emitting neutrons and measuring the neutron cloud from the detected emission of gamma rays produced from the inelastic interaction of the emitted neutrons through the matter occupying the physical space through which the neutrons were emitted.

Water front sensor 207 may be positioned within the tubing 210, positioned on the tubing 210, positioned on the electronic inflow control device 300, or positioned within the electronic inflow control device 300, as desired. In examples, water front sensor 207 may be coupled to the exterior or the interior of the tubing 210 or the electronic inflow control device 300 using any sufficient means including threaded connections, welded connections, clamps, adhesives, etc. Water front sensor 207 may be placed within the wellbore at any location where the water front sensor 207 is operable to detect a water front that could potentially contact the electronic inflow control device 300 or other completion equipment.

In some examples, water front sensor 207 may be connected to or may comprise a signaling device (e.g., signaling device 218 as illustrated in FIG. 2) operable to signal receiver 310 of the electronic inflow control device 300. The connection of water front sensor 207 to the signaling device may comprise any sufficient connection for the signaling device to receive such signal and to transmit such signal to the receiver 310 of the electronic inflow control device 300. The connection of the water front sensor 207 to the signaling device may comprise a wired or wireless connection. In some examples, the signaling device may be an integrated component of the water front sensor 207. In alternative examples, the water front sensor 207 may convey the measurement data to an operator who may operate a signaling device as desired to signal receiver 310 and induce actuation of flow regulator 304. In some of these alternative examples, the signaling device may function as a receiver for receiving the measurement data from the water front sensor 207. It is to be understood that the measurement data may be processed or unprocessed data and in some examples may not indicate that a water front is approaching without the appropriate data processing.

In some examples, water front sensor 207 may comprise a water front sensor signal transmitter 208 and water front sensor signal receiver 209, as illustrated in FIG. 3. In examples where the water front sensor 207 comprises an electromagnetic sensor, the water front sensor signal transmitter 208 may transmit electromagnetic waves into the annular space, the near-wellbore region, and/or the deep-wellbore region dependent upon the capabilities of the water front sensor signal transmitter 208. Without limitation by theory, the water front sensor signal transmitter 208 transmits the electromagnetic waves at any desired frequency to generate a primary field. The transmitted electromagnetic waves interact with matter occupying the physical space through which the electromagnetic waves are transmitted. This interaction generates secondary fields. The properties of the secondary field are a function of the resistivity of the matter through which the electromagnetic waves were transmitted. The water front sensor signal receiver 209 may measure the total field and by comparison of the variation in the resistivity to a baseline measurement, it may be determined that a water front is approaching. The variation in resistivity of the total field accounts for the difference between the resistivity of the primary field relative to the resistivity of the secondary field. The baseline measurement may be taken at any time as desired and may be a single measurement or an average of multiple measurements. For example, the baseline measurement may be taken during early production and may comprise a multi-day average. In some examples, the resistivity may be a complex value. In some examples, the resistivity may be a real and an imaginary component. The imaginary component may represent the charge capacitance, inductance, or any other value of the reservoir as the water flows.

In some examples, the water front sensor 207 may comprise a neutron logging sensor. The neutron logging sensor may function analogously to the electromagnetic sensor example described above. For example, the neutron logging sensor would comprise a water front sensor signal transmitter 208 and a water front sensor signal receiver 209. The water front sensor signal transmitter 208 would comprise a radioactive source or any other type of neutron generator operable to emit neutrons into the formation. As the neutrons inelastically interact with the matter occupying the physical space through which the neutrons are emitted, the neutrons are absorbed and gamma rays are emitted which may be detected by the water front sensor signal receiver 209. The water front sensor signal receiver 209 may comprise a scintillation detector, semiconductor-based detector, or any other type of detector operable to detect the emitted gamma rays. The measurements may be used to measure the neutron cloud surrounding the water front sensor signal transmitter 208 (i.e., the radioactive source), and from this a neutron log may be developed. Variation in the neutron log, compared to a baseline, may indicate the approach of a water front.

In some examples, the water front sensor 207 may comprise multiples of the water front sensor signal transmitter 208 and/or the water front sensor signal receiver 209. For example, water front sensor 207 may comprise a single water front sensor signal transmitter 208 and multiple water front sensor signal receivers 209. In said example, the one or more of the multiple water front sensor signal receivers 209 may be spaced apart from the water front sensor signal transmitter 208 and each other such that the water front sensor signal receivers 209 are capable of measuring an approaching water front across a larger portion of the formation (e.g., formation 112, as illustrated in FIG. 2), relative to measurement from a single water front sensor signal receiver 209.

As shown in FIG. 3, an additional water front sensor 207 may be used in some examples. The additional water front sensor 207 may be positioned uphole or downhole of any other water front sensor 207. Any number of additional water front sensors 207 may be used. The water front sensors 207 may be placed in the wellbore as desired and located at any desired distance from one another. In some examples, an electronic inflow control device 300 may comprise multiple water front sensors 207. For example, FIG. 3 illustrates two water front sensors 207 positioned on the exterior of the tubing 210, adjacent to the terminal ends of the electronic inflow control device 300. Multiple water front sensors 207 may be used to sense the potential approach of a water front across a broader area of the formation (e.g., formation 112, as illustrated in FIG. 2), relative to the use of a single water front sensor 207. In turn, this may allow the operator to speculate as to which specific sections of the completion the water front may potentially contact and to plan accordingly. For example, the operator may actuate the flow regulator 304 of any electronic inflow control device 300 uphole of an electronic inflow control device 300 that will be contacted by sensed water front. As such, the operator may be able to create a flow profile for a series of electronic inflow control devices 300 across the completion to reduce the production of water as desired from an approaching water front.

Figure 5:
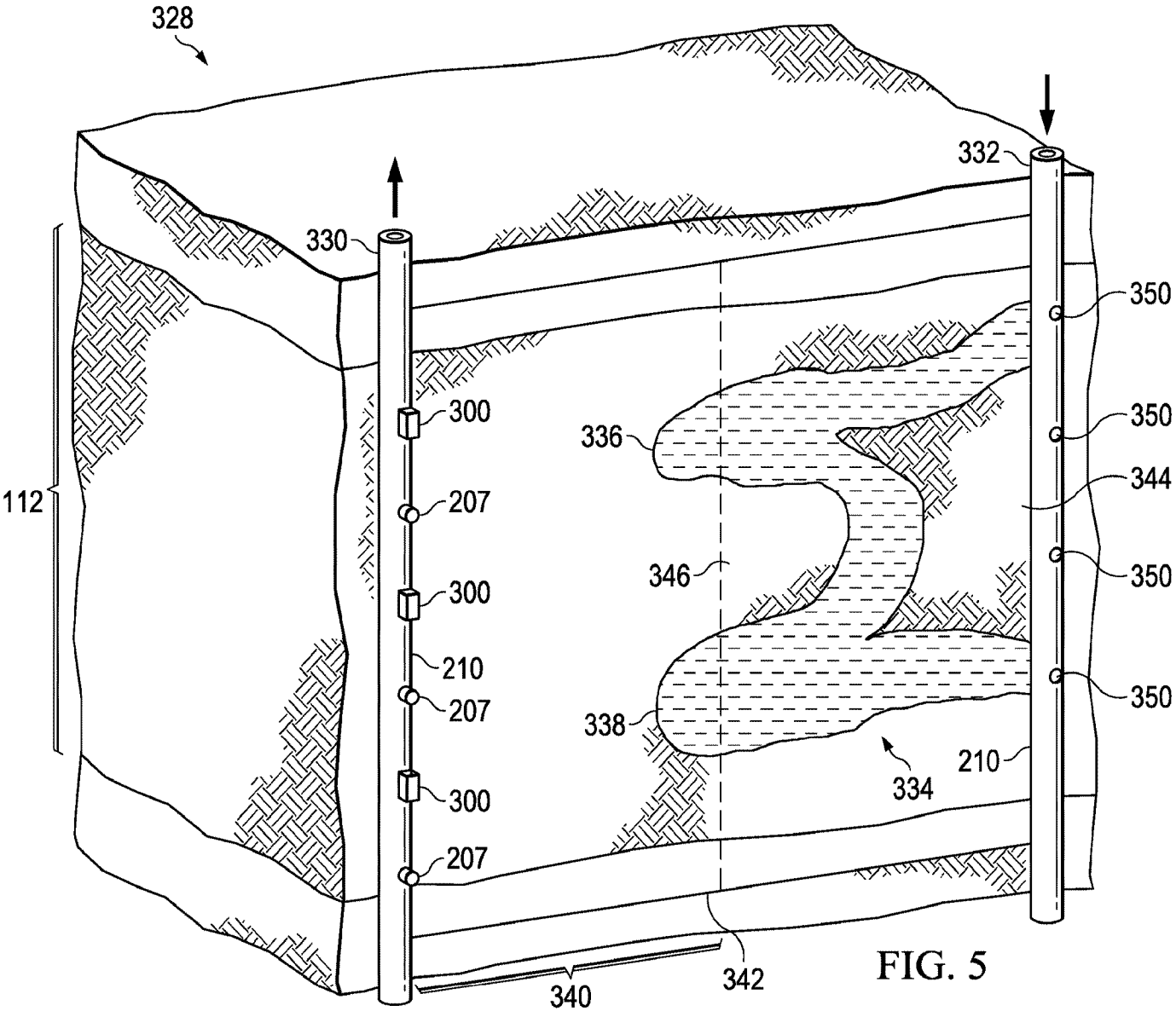
FIG. 5 is an elevation view of two water fronts approaching a well system.

FIG. 5 illustrates a dual well system 328 and the detection of an introduced water front into one of the wells. FIG. 5 depicts two distinct wells. Well 330 is a producing well with electronic inflow control devices 300 positioned along tubing 210. The electronic inflow control devices 300 comprise water front sensors 207 having sensing range 340 defined by sensing range border 338. In this example, sensing range 340 encompasses the well 330 annulus, the well 330 near-wellbore region, and the well 330 deep-wellbore region. Well 332 is an injection well conducting a water flood operation, which has injection water 334 along the length of its tubing 210 via injection ports 350. As the injection water 334 flows through formation 112, two water fronts 336 and 338 begin to approach well 330. As water fronts 336 and 338 cross sensing range border 338 and enter sensing range 340, water front sensors 207 may detect the approach of water fronts 336 and 338. For example, the water fronts 336 and 338 may alter the resistivity of the formation 112 within sensing range 340, and the water front sensors 207 may detect this altered resistivity of formation 112. The contrasting resistivities of formation 112 may be used to sense the approach of water fronts 336 and 338 to well 330. In response to the approaching water fronts 336 and 338, electronic inflow control devices 300 may adjust their inflow through actuation of their respective flow regulators, for example, flow regulators 304 as illustrated on FIG. 3. Further, an operator may decide to produce a flow profile for the completion by selectively regulating the inflow of specific electronic inflow control devices 300 along the completion. As such, the productivity of well 330 may be increased and the amount of water produced from water fronts 336 and 338 may be reduced. Alternatively, the operator may decide to restrict the production through the electronic inflow control device 300 as the water front approaches. When water is no longer detected, the operator may decide to stop restriction of production through the electronic inflow control device 300.

With continued reference to FIG. 5, injection water 334 from well 332 may not traverse formation 112 uniformly. As illustrated, portion 344 of injection water 334 has encountered resistance to fluid flow in formation 112, for example, due to reduced porosity of portion 346 of formation 112. Because of this resistance to fluid flow through portion 346 of formation 112, the injection water 334 has formed two water fronts 336 and 338 instead of a uniform water front. The detection of two water fronts 336 and 338 by water front sensors 207 may allow the operator of well 332 to adjust the injection of injection water 334 from well 332 as desired. For example, the operator may choose to inject an increased amount of injection water 334 from the injection ports 350 abutting portion 344 of injection water 334, or alternatively, to reduce the injection of injection water 334 from injection ports 350 which do not abut portion 344 of injection water 334. As such, an operator of well 332 may be able to produce a controlled water front as desired in response to the water front sensors 207 of well 330 sensing the approach of water fronts 336 and 338. Although the disclosed examples describe the detection of water fronts, gas fronts (e.g., methane) may be detected in an analogous manner if desired based on the resistivity contrasts or neutron log contrasts between a formation comprising an approaching gas and a previously measured baseline reading.

FIG. 5 depicts a method for the detection of a water front. It is to be understood that the detected water may be in any form. For example, the water may comprise liquid water, water vapor, or a supercritical fluid. FIG. 5 also depicts a water flood operation, however, it is to be understood that the above illustration may also be used with a steam flood operation, steam assisted gravity drainage, or any other operation which may utilize the injection of water (in any form) into a subterranean formation and/or wellbore.

Referring again to FIGS. 3 and 4, as discussed above, electronic inflow control device 300 may include flow regulator 304, which may be adjustable to provide varying degrees of flow resistance, and generator 306, which may be configured to utilize the kinetic energy of a fluid flowing through electronic inflow control device 300 to generate electrical power. As discussed, electronic inflow control device 300 may also include receiver 310 operable to receive signals from a signaling device (e.g., signaling device 218 as illustrated in FIG. 2). Controller 312 may be communicatively coupled to receiver 310 and operable to control the adjustment of the flow resistance provided by flow regulator 304 in response to signals received by receiver 310 from a signaling device.

Fluid circulating in a wellbore (e.g., wellbore 114, as illustrated in FIG. 1), may flow into electronic inflow control device 300 via inlet 302 and may flow through flow regulator 304 and then through generator 306 before exiting electronic inflow control device 300 via outlet 308. Flow regulator 304 may include a flow restricting device adjustable to provide varying degrees of flow resistance. For example, flow regulator 304 may include a valve controlled by an actuator to increase or decrease the flow resistance. The flow resistance provided by the valve may increase as the valve is moved from a fully or partially open position towards a closed position and may decrease as the valve is moved from a closed or partially open position towards a fully open position. As another example, flow regulator 304 may include an orifice with an insert controlled by an actuator that may be moved axially into the orifice to increase or decrease the flow resistance. The flow resistance provided by the insert may increase as the insert extends into the orifice and may decrease as the insert is withdrawn from the orifice. As yet another example, flow regulator 304 may include an adjustable vortex diode. The flow resistance provided by the diode may be increased or decreased by changing the angle at which fluid flows into the diode. The flow resistance provided by the diode may be at a maximum when the fluid enters the diode tangentially to the diode wall and at a minimum when the fluid enters the diode radially.

Generator 306 may include any generator configured to generate electrical power. For example, generator 306 may include a turbine generator configured to utilize the kinetic energy of fluid flowing through electronic inflow control device 300 to generate electrical power. The features and operation of an exemplary turbine generator are discussed below in conjunction with FIG. 4. As additional examples, generator 306 may include a piezoelectric generator or vortex generator configured to utilize vibrations induced by fluid flowing through electronic inflow control device 300 to generate electrical power. As yet another example, generator 306 may include a nuclear generator configured to utilize nuclear energy to generate electrical power. The electrical power generated by generator 306 may be supplied to components of electronic inflow control device 300, including receiver 310, controller 312, and flow regulator 304. Electronic inflow control device 300 may also include a power storage device that may store electrical power generated by generator 306 or another component of the well system (e.g., well-production system 100, as illustrated in FIG. 1), and supply electrical power to one or more components of electronic inflow control device 300, including receiver 310, controller 312, and flow regulator 304.

In some examples, generator 306 may supply electrical power to water front sensor 207. In alternative example, water front sensor 207 may be supplied with power independently from generator 306 and/or may comprise its own power supply, for example, water front sensor 207 may be powered by batteries.

Receiver 310 may receive signals from a signaling device (e.g., signaling device 218 as illustrated in FIG. 2). For example, receiver 310 may be operable to receive signals from a signaling device located at well site 106 (illustrated in FIG. 1), within the wellbore 114 (illustrated in FIG. 1) at the location of the electronic inflow control device 300, within the wellbore 114 (illustrated in FIG. 1) at a location different from the location of the electronic inflow control device 300, within the wellbore 114 (illustrated in FIG. 1) at the location of a water front sensor 207, within wellbore 114 (illustrated in FIG. 1) at a location different from the location of a water front sensor 207, or within a lateral wellbore. The signals received by receiver 310 from the signaling device may include commands to adjust the flow resistance provided by electronic inflow control device 300. For example, water front sensor 207 may detect an approaching water front from the formation 112 (as illustrated in FIG. 5). The water front sensor 207 may convey this information to an operator who may operate the signaling device if desired, or the information may be conveyed directly to the signaling device. The signaling device may then signal the receiver 310 to induce actuation of the flow regulator 304 as instructed.

In some alternative examples, receiver 310 may comprise a sensor to provide additional functionality such that receiver 310 may be able to measure variations in the pressure or flow rate of a fluid flowing through electronic inflow control device 300. For example, the rate of fluid flow through electronic inflow control device 300 may be dependent upon the rate of fluid flow in wellbore 114 (illustrated in FIG. 1), which may be controlled by an operator at well site 106 (illustrated in FIG. 1). The operator may control the rate of fluid flow in wellbore 114 (illustrated in FIG. 1) by, for example, controlling a choke, the bypass around a choke, or the backpressure at well site 106 (illustrated in FIG. 1). These variations in pressure and/or flow rate generated by the operations of the operator may be used to generate a plurality of pressure profiles or flow rate profiles, each of which may correspond to a command to adjust the flow resistance provided by electronic inflow control device 300. In these examples, receiver 310 may be operable to detect variations in the pressure and flow rate of fluid flowing through the electronic inflow control device 300 by, for example, measuring the rate of rotation or vibration of generator 306, where generator 306 includes a turbine generator, piezoelectric generator or vortex generator. Receiver 310 may include an accelerometer, hydrophone, or any other device operable to detect variations in the pressure or flow rate of fluid flowing through electronic inflow control device 300.

With continued reference to FIGS. 3 and 4, in response to the signals received by receiver 310, a controller 312 may actuate flow regulator 304 to perform the particular command corresponding to the signal received by receiver 310. For example, a water front sensor 207 may detect an approaching water volume adjacent to an electronic inflow control device 300. An operator may use the signaling device (e.g., signaling device 218 as illustrated in FIG. 2) to signal the electronic inflow control device 300 adjacent to the approaching water volume to increase fluid flow resistance such that the amount of water produced is reduced. In addition, or alternatively, the operator may signal one or more electronic inflow control devices 300 which may be uphole and/or downhole from the specific electronic inflow control device 300 adjacent to the approaching water volume in order to create a desired pressure or flow profile for the series of electronic inflow control devices 300 prior to the approaching water volume contacting the electronic inflow control device 300 adjacent to it. Particular pressure or flow rate profiles may correspond to commands to adjust the flow resistance provided by flow regulator 304 to a particular value, to adjust the flow resistance provided by flow regulator 304 to a minimum (e.g., fully open flow regulator 304), to adjust the flow resistance provided by flow regulator 304 to a maximum (e.g., fully close regulator 304), or to perform any command after a specified time delay. When receiver 310 is signaled by the signaling device, the controller 312 may actuate the flow regulator 304 to adjust the flow resistance provided by the flow regulator 304 according to the command corresponding to the particular desired pressure or flow rate profile. In some examples of the electronic inflow control device 300, the electronic inflow control device 300 may be able to selectively restrict the fluid flow of water. As such, the amount of water produced may be greatly reduced in examples in which the electronic inflow control device 300 may configured to selectively restrict the fluid flow of water prior to the water entering the electronic inflow control device 300.

Additionally, signals may be transmitted from electronic inflow control device 300 to another location, such as well site 102 (illustrated in FIG. 1) or other flow control devices within well-production system 100 (illustrated in FIG. 1) using variations in the pressure or flow rate of fluid flowing through electronic inflow control device 300, which may be detected at well site 102 (illustrated in FIG. 1) or by a receiver 310 in a different electronic inflow control device 300 within well-production system 100 (illustrated in FIG. 1). For example, controller 312 may actuate flow regulator 304 to increase or decrease the rate of fluid flow through electronic inflow control device 300 to generate a plurality of pressure or flow rate profiles, each of which may correspond to a particular message or signal to be transmitted to well site 102 (illustrated in FIG. 1) or another electronic inflow control device 300. Messages or signals transmitted to well site 102 (illustrated in FIG. 1) or another electronic inflow control device 300 may include information relating to the status and/or operability of electronic inflow control device 300, measurements taken by water front sensor 207, measurements taken by receiver 310, the flow resistance provided by flow regulator 304, verification that signals transmitted to electronic inflow control device 300 from well site 102 (illustrated in FIG. 1) and/or another electronic inflow control device 300 were received, commands to adjust the pressure and/or flow rate at well site 102 (illustrated in FIG. 1) and/or another electronic inflow control device 300, and combinations thereof.

In optional examples, electronic inflow control device 300 may comprise a battery 311. The battery 311 may be a primary or secondary battery. The battery may be coupled to the receiver 310 and/or the controller 312 as desired. In optional examples comprising a secondary battery 311, the secondary battery may be further coupled to generator 306 to allow generator 306 to recharge battery 311.

Although electronic inflow control device 300 is illustrated in FIG. 4 as including a flow regulator 304 in series with a generator 306, many other configurations may be utilized. For example, an electronic inflow control device 300 may include a flow regulator 304 in parallel with a generator 306 (illustrated in FIG. 7), a flow regulator 304 in parallel with a generator 306 and a bypass (illustrated in FIG. 8), a flow regulator 304 in series with a generator 306 and a bypass (illustrated in FIG. 9), and a flow regulator 304 in parallel with a fluid diode and in series with a generator 306 (illustrated in FIG. 10). Although a battery (e.g., battery 311 as illustrated in FIG. 4) is not depicted in these alternative configurations, it is to be understood that a battery may be added to any of these configurations if desired. Each of these configurations is discussed individually below.

Figure 6:
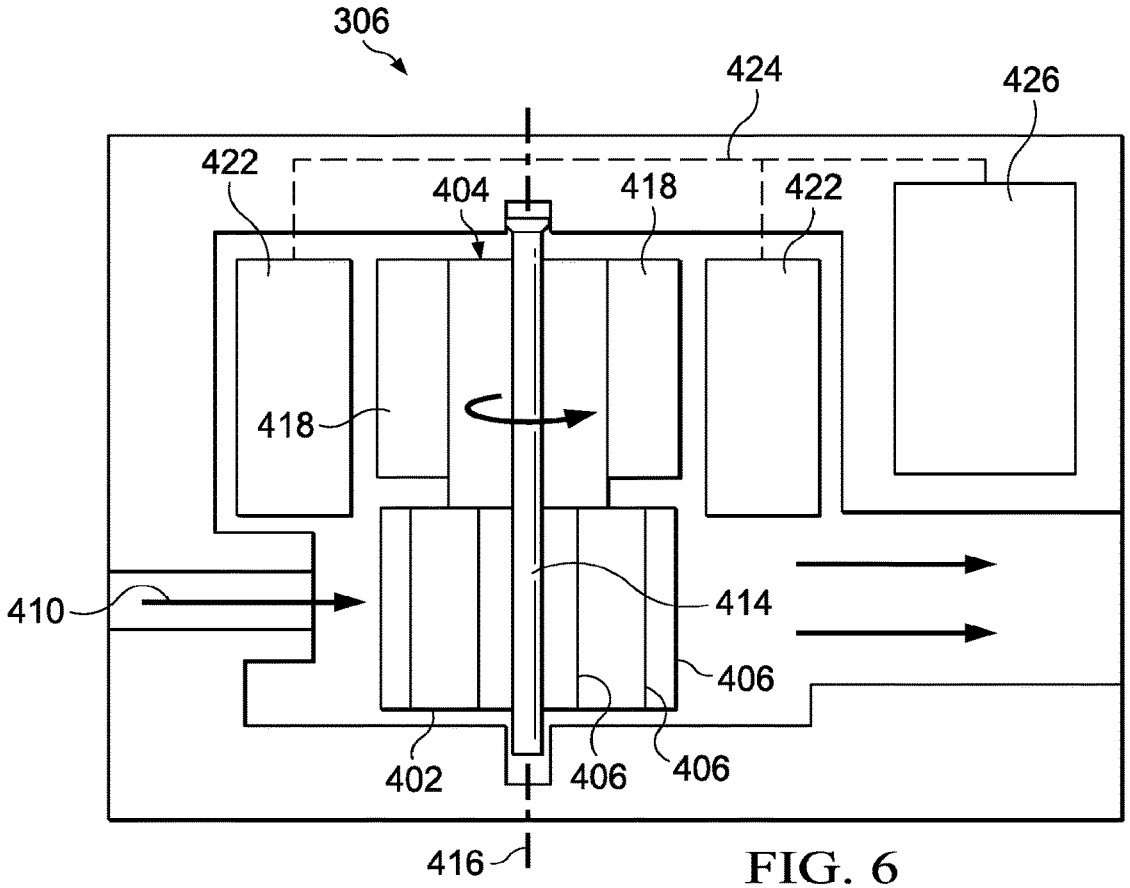
FIG. 6 is a schematic of a generator configured to utilize the kinetic energy of fluid flow to generate electrical power.

FIG. 6 is a schematic of a generator 306 configured to utilize the kinetic energy of fluid flow to generate electrical power. As shown in FIG. 6, generator 306 may include turbine assembly 402 coupled to a power generator 404. Turbine assembly 402 may include a plurality of blades 406 positioned about rotational axis 416 of turbine assembly 402. Turbine assembly 402 may be coupled to generator 404 via rotor 414. Generator 404 may include a plurality of magnets 418 coupled to rotor 414 and a plurality of coil windings 422 coupled to power conditioning unit 426.

Fluid may flow through generator 306 via flow path 410 and may induce rotation of blades 406. Rotation of blades 406 of turbine assembly 402 may induce rotation of rotor 414, which may in turn induce rotation of magnets 418 of generator 404. The rotation of magnets 418 may generate a magnetic field, which may induce current in coil windings 422. The current may flow from coil windings 422 to power conditioning unit 426 via leads 424. Power conditioning unit 426 may be configured to, among other things, store and deliver electrical power generated by generator 306. Power may be delivered from power conditioning unit 426 to components of electronic inflow control device 300, including, but not limited to, receiver 310, controller 312, and flow regulator 304. Alternatively, leads 424 may extend directly to components of electronic inflow control device 300 in order to provide electrical power directly to such components.

Although turbine assembly 402 is illustrated in FIG. 6 as a transverse flow turbine assembly in which fluid flow through the turbine is substantially perpendicular to the rotational axis of the turbine assembly, turbine assembly 402 may also include an axial flow turbine assembly, in which fluid flow through the turbine is substantially parallel to the rotational axis 416 of the turbine assembly 402. Additionally, although generator 306 is illustrated in FIG. 6 as a permanent magnet alternating current (AC) generator that uses pairs of magnets 318 with alternating poles that rotate relative to the coil windings 322 to generate an AC signal, other types of generators may be used. For example, generator 306 may include a transverse flux generator, radial flux generator, axial flux generator, direct current (DC) generator, alternator, or any other suitable type of generator.

Figure 7:
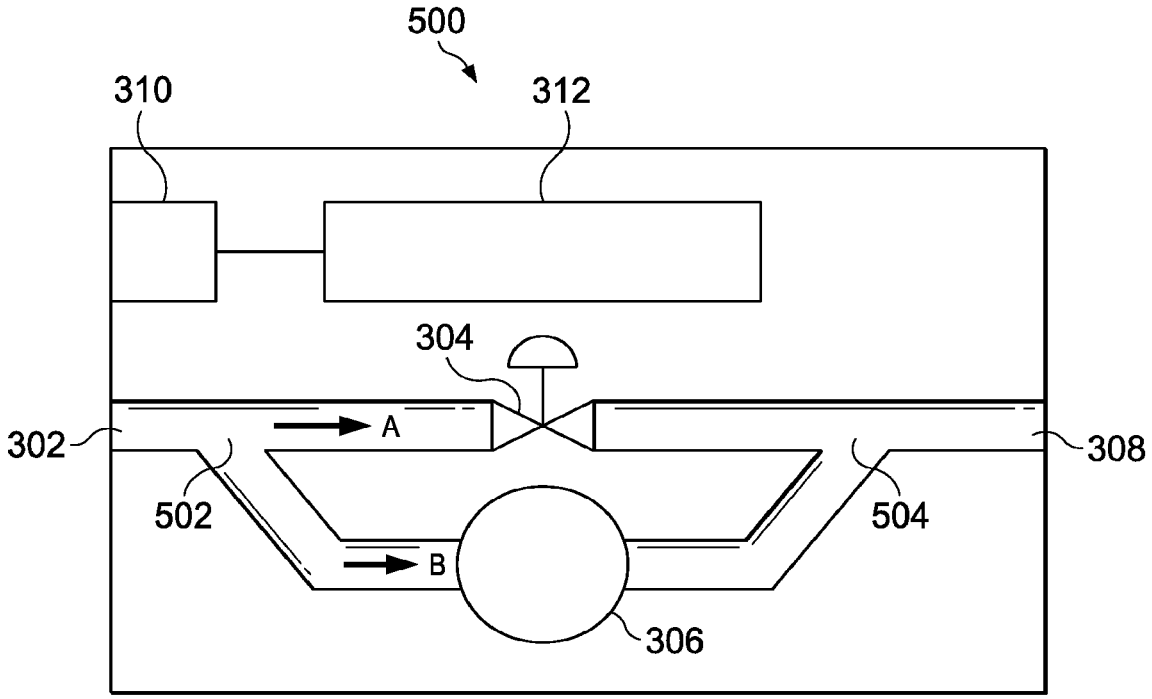
FIG. 7 is a schematic of an electronic inflow control device including a flow regulator in parallel with a generator.

FIG. 7 is a schematic of an electronic inflow control device 500 including a flow regulator 304 in parallel with a generator 306. Like the electronic inflow control device 300 (illustrated in FIG. 4), electronic inflow control device 500 may include flow regulator 304, generator 306, receiver 310, and controller 312. Unlike electronic inflow control device 300 (illustrated in FIG. 4), fluid flowing through electronic inflow control device 500 may flow through flow regulator 304 and generator 306 in parallel. For example, fluid circulating in a wellbore, for example, wellbore 114 (illustrated in FIG. 1), may flow into electronic inflow control device 500 via inlet 302, and at junction 502 the fluid flow may split into two parallel flows. Parallel flow A may flow through flow regulator 304 and parallel flow B may flow through generator 306. Parallel flows A and B may rejoin at junction 504 before exiting electronic inflow control device 500 via outlet 308. Because flow regulator 304 and generator 306 are placed in parallel within electronic inflow control device 500, fluid may flow through generator 306 even if flow regulator 304 is completely closed. Thus, generator 306 may generate electrical power even when flow regulator 304 is completely closed. This may not be possible where, as shown in FIG. 4, flow regulator 304 and generator 306 are in series.

Electronic inflow control device 500 may also include a power storage device that may store electrical power generated by generator 306 or another component of the well system (e.g., well-production system 100, as illustrated in FIG. 1), and supply electrical power to components of electronic inflow control device 500, including receiver 310, controller 312, and flow regulator 304.

Figure 8:
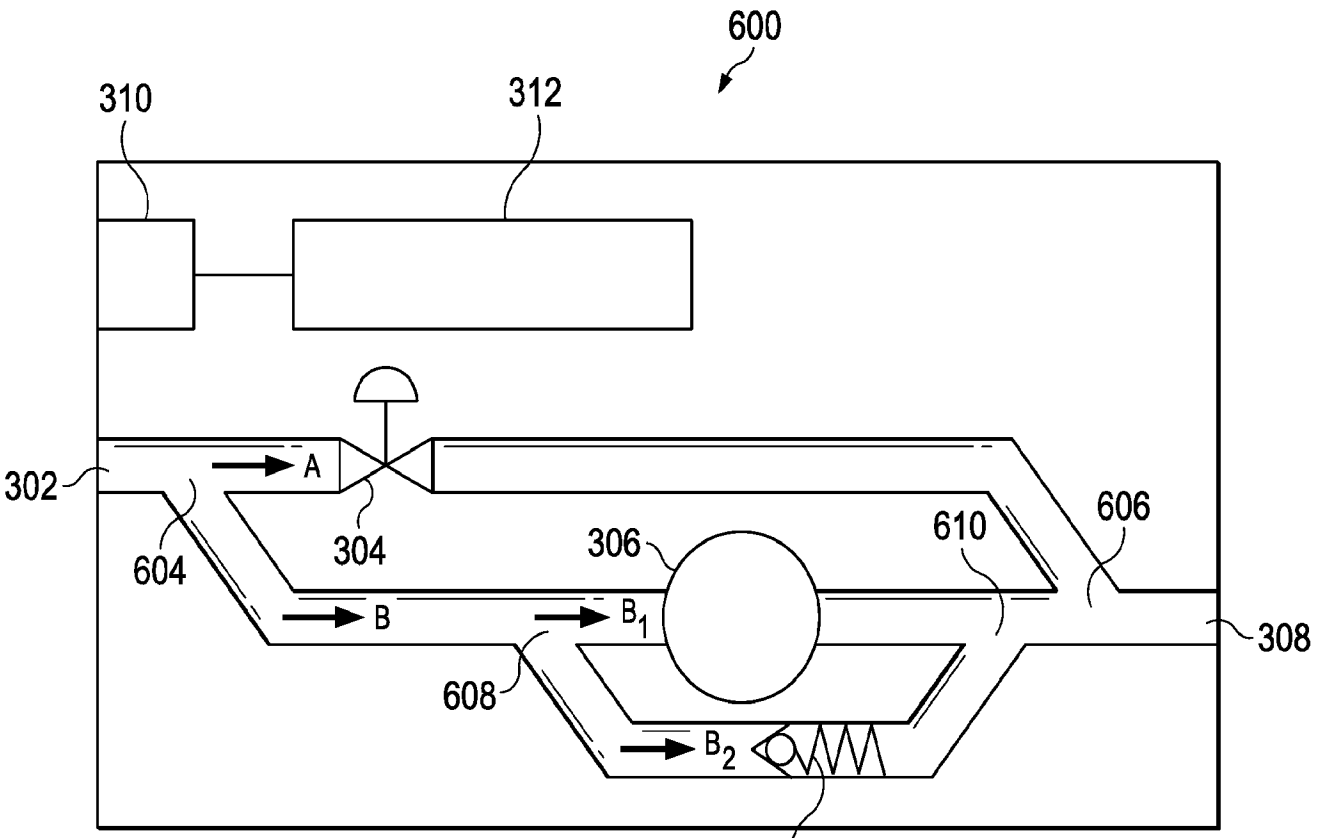
FIG. 8 is a schematic of an electronic inflow control device including a flow regulator in parallel with a generator and a bypass.

FIG. 8 is a schematic of an electronic inflow control device 600 including a flow regulator 304 in parallel with a generator 306 and a bypass. Like electronic inflow control device 300 (illustrated in FIG. 4) electronic inflow control device 600 may include flow regulator 304, generator 306, receiver 310, and controller 312. Because flow regulator 304 and generator 306 are placed in parallel within electronic inflow control device 600, fluid may flow through the generator 306, and the generator 306 may generate electrical power even if the flow regulator 304 is completely closed. This may not be possible where, as shown in FIG. 4, the flow regulator 304 and generator 306 are in series. Electronic inflow control device 600 may also include bypass valve 602 in fluidic parallel with flow regulator 304 and generator 306. Bypass valve 602 may control fluid flow through generator 306 by increasing fluid flow to generator 306 when the rate of fluid flow through electronic inflow control device 600, and thus the pressure of the fluid flowing through electronic inflow control device 600, is low. Alternatively, bypass valve 602 may control fluid flow through generator 306 by decreasing fluid flow to generator 306 when the rate of fluid flow through electronic inflow control device 600, and thus the pressure of the fluid flowing through electronic inflow control device 600, is high.

Fluid circulating in a wellbore (e.g., wellbore 114, as illustrated in FIG. 1) may flow into electronic inflow control device 600 via inlet 302 and, at junction 604 the fluid flow may split into two parallel flows. Parallel flow A may flow through flow regulator 304, while parallel flow B may again split into two parallel flows at junction 608. Parallel flow B1 may flow through generator 306, while parallel flow B2 may flow to bypass valve 602. When bypass valve 602 is open, parallel flow B2 may flow through bypass valve 602 and may rejoin parallel flow B1 at junction 610. When bypass valve 602 is closed, parallel flow B2 may flow back to towards junction 608 and rejoin parallel flow B1. Parallel flows B1 and B2 may rejoin parallel flow A at junction 606 before exiting electronic inflow control device 600 via outlet 308.

Bypass valve 602 may be a spring loaded valve configured to open when the rate of fluid flow through electronic inflow control device 600 is high and the pressure exerted on bypass valve 602 by the fluid flow exceeds a threshold pressure or the rate of fluid flow through electronic inflow control device 600 exceeds a threshold value. When bypass valve 602 is open, parallel flow B2 may flow through bypass valve 602, thus reducing the rate of fluid flow through generator 306 and the pressure exerted on generator 306 by the fluid flow. Bypass valve 602 may be configured to close when the rate of fluid flow through electronic inflow control device 600 is low and the pressure exerted on bypass valve 602 by the fluid flow drops below the threshold pressure or the rate of fluid flow through electronic inflow control device 600 drops below the threshold pressure. When bypass valve 602 is closed, parallel flow B2 may flow back towards junction 608 and rejoin parallel flow B1 before flowing through generator 306, thus increasing the rate of fluid flow through generator 306. By increasing the rate of fluid flow through generator 306 when the rate of fluid flow through electronic inflow control device 600 is low, generator 306 may be able to continue generation of electrical power even when the rate of fluid flow through electronic inflow control device 600 is low.

Electronic inflow control device 600 may also include a power storage device that may store electrical power generated by generator 306 or another component of the well system, for example, well-production system 100 (illustrated in FIG. 1), and supply electrical power to components of electronic inflow control device 600, including receiver 310, controller 312, and flow regulator 304.

Figure 9:
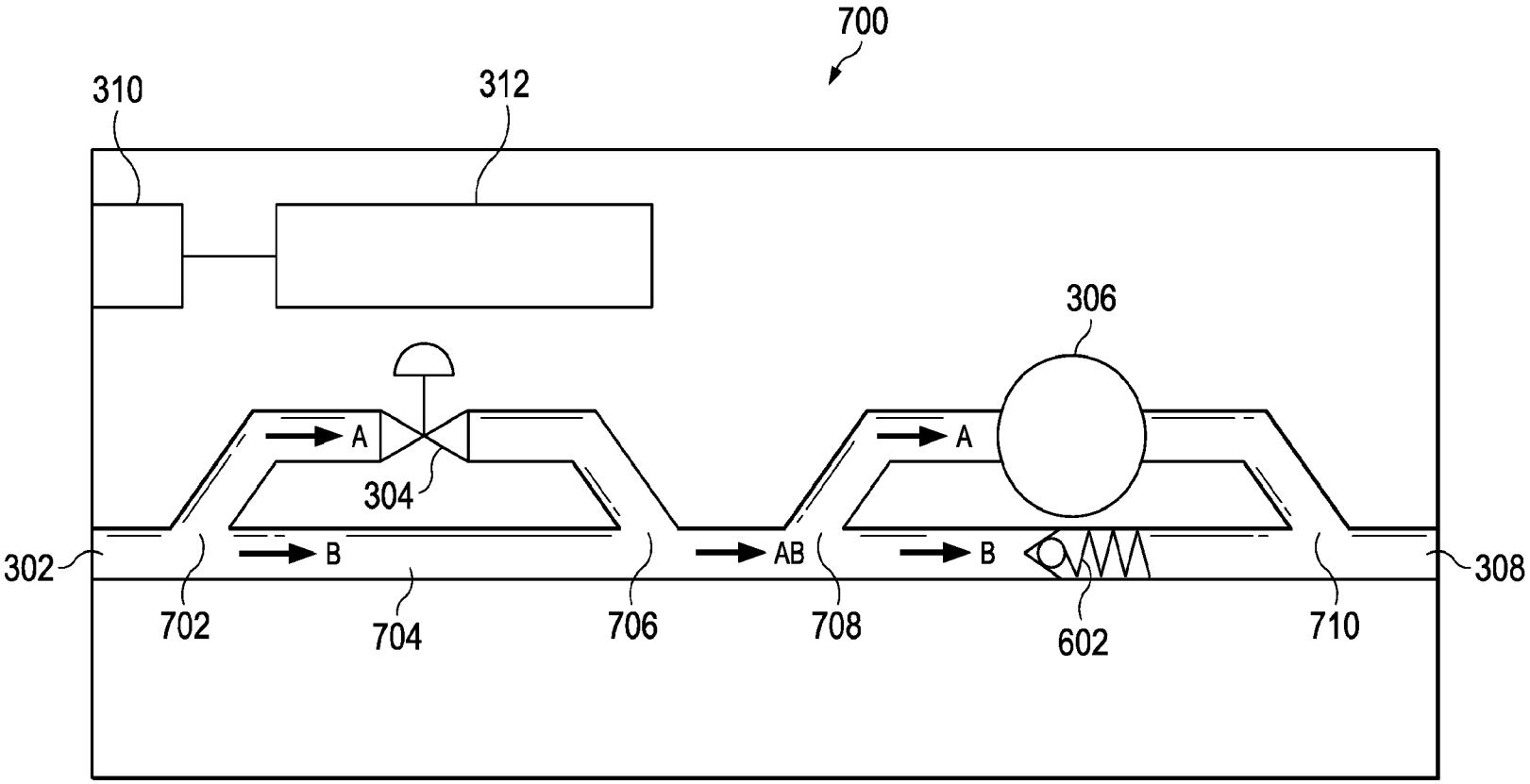
FIG. 9 is a schematic of an electronic inflow control device including a flow regulator in series with a generator and a bypass in parallel with the generator.

FIG. 9 is a schematic of an electronic inflow control device 700 including a flow regulator 304 in series with a generator 306 and a bypass in parallel with the generator 306. Like electronic inflow control device 300 (illustrated in FIG. 4), electronic inflow control device 700 may include flow regulator 304, generator 306, receiver 310, and controller 312. Electronic inflow control device 700 may also include bypass valve 602 in fluidic parallel with generator 306. Although flow regulator 304 and generator 306 may be in series with one another in electronic inflow control device 700, bypass flow path 704 may permit fluid flow to generator 306 even when flow regulator 304 is completely closed. Thus, generator 306 may generate electrical power even when flow regulator 304 is completely closed. This may not be possible where, as shown in FIG. 4, flow regulator 304 and generator 306 are in series without a bypass flow path.

Fluid circulating in a wellbore, for example, wellbore 114 (illustrated in FIG. 1), may flow into electronic inflow control device 700 via inlet 302 and, at junction 702 the fluid flow may split into two parallel flows. Parallel flow A may flow through flow regulator 304, while parallel flow B through bypass flow path 704. Parallel flows A and B may rejoin at junction 706 to form composite flow AB. Composite flow AB may again split into two parallel flows at junction 708. When bypass valve 602 is open, parallel flow A may flow through generator 306, and parallel flow B may flow through bypass valve 602 before rejoining at junction 710 and exiting electronic inflow control device 700 via outlet 308. When bypass valve 602 is closed, however, parallel flow B may flow to, but not through, bypass valve 602, while parallel flow A may flow through generator 306 before exiting electronic inflow control device 700 via outlet 308.

As discussed above with respect to FIG. 8, bypass valve 602 may be configured to open when the rate of fluid flow through electronic inflow control device 700 is high and the pressure exerted on bypass valve 602 by the fluid flow exceeds a threshold pressure. When bypass valve 602 is open, parallel flow B may flow through bypass valve 602, thus reducing the rate of fluid flow through generator 306 and the pressure exerted on generator 306 by the fluid flow. Bypass valve 602 may be configured to close when the rate of fluid flow through electronic inflow control device 700 is low and the pressure exerted on bypass valve 602 by the fluid flow drops below the threshold pressure. When bypass valve 602 is closed, parallel flow B may flow back to towards junction 708 and rejoin parallel flow A to form composite flow AB before flowing through generator 306, thus increasing the rate of fluid flow through generator 306. By increasing the rate of fluid flow through generator 306 when the rate of fluid flow through electronic inflow control device 700 is low, generator 306 may be able to continue generation of electrical power even when the rate of fluid flow through electronic inflow control device 700 is low.

Electronic inflow control device 700 may also include a power storage device that may store electrical power generated by generator 306 or another component of a well system, for example, well-production system 100 (illustrated in FIG. 1), and supply electrical power to components of electronic inflow control device 700, including receiver 310, controller 312, and flow regulator 304.

Figure 10:
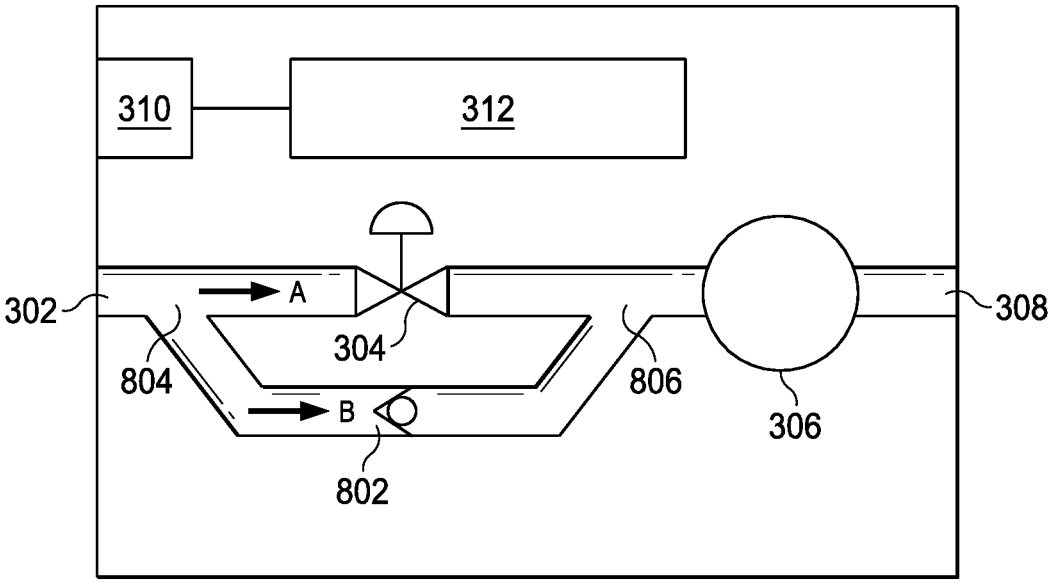
FIG. 10 is a schematic of an electronic inflow control device including a flow regulator in parallel with a fluid diode and in series with a generator.

FIG. 10 is a schematic of an electronic inflow control device 800 including a flow regulator 304 in parallel with a fluid diode and in series with a generator 306. Like electronic inflow control device 300 (illustrated in FIG. 4), electronic inflow control device 800 may include flow regulator 304, generator 306, receiver 310, and controller 312. Electronic inflow control device 800 may also include fluid diode 802 in fluidic parallel with regulator 304. Fluid diode 802 may permit fluids flowing through electronic inflow control device 800 to bypass flow regulator 304 and provide fluid flow to generator 306 even when flow regulator 304 is completely closed. This may permit generator 306 to generate electrical power even when flow regulator 304 is completely closed. This may not be possible where, as shown in FIG. 4, flow regulator 304 and generator 306 are in series without a bypass flow path.

Fluid circulating in a wellbore, for example, wellbore 114 (illustrated in FIG. 1), may flow into electronic inflow control device 800 via inlet 302 and, at junction 804 the fluid flow may split into two parallel flows. Parallel flow A may flow through flow regulator 304, while parallel flow B through bypass flow path 704. When flow regulator 304 is open, parallel flow A may flow through flow regulator 304 and parallel flow B may flow through fluid diode 802. Parallel flows A and B may rejoin at junction 806 and may flow through generator 306 before exiting electronic inflow control device 800 via outlet 308. When flow regulator 304 is closed, parallel flow A may flow to, but not through, flow regulator 304, while parallel flow B may flow through fluid diode 802 and generator 306 before exiting electronic inflow control device 800 via outlet 308.

Electronic inflow control device 800 may also include a power storage device that may store electrical power generated by generator 306 or another component of a well system, for example, well-production system 100 (illustrated in FIG. 1), and supply electrical power to components of electronic inflow control device 800, including receiver 310, controller 312, and flow regulator 304.

Figure 11:
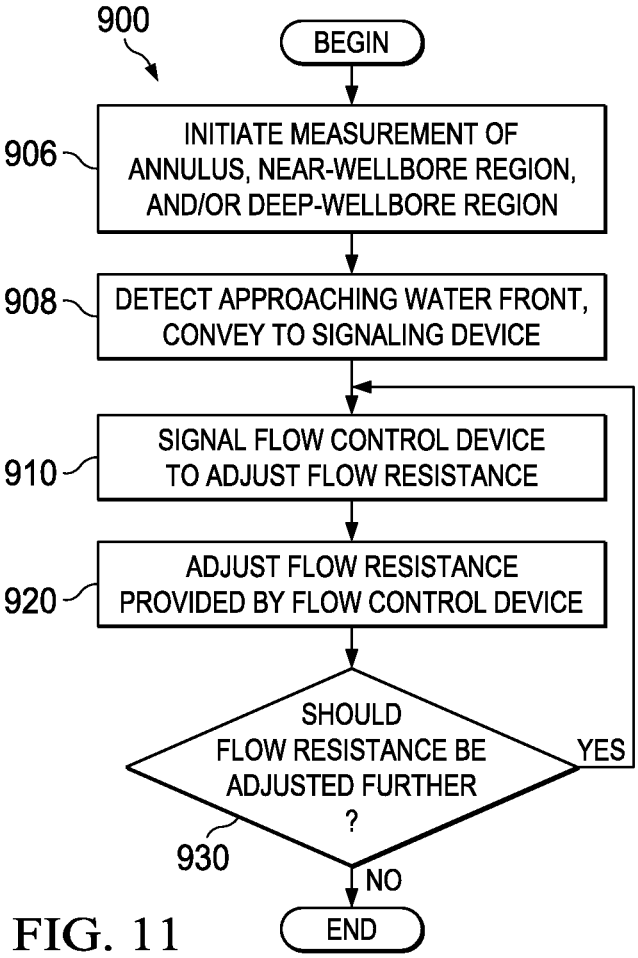
FIG. 11 is a flow chart of a method of regulating fluid flow into or out of a wellbore.

FIG. 11 illustrates a method of regulating fluid flow into or out of a wellbore. Method 900 may begin at step 906, where a water front sensor may be used to measure the annulus, the near-wellbore region, and the deep-wellbore region for the presence of an approaching water front. The method continues to step 908 if a water front is detected, and this information is conveyed to a signaling device (e.g., signaling device 218 as illustrated in FIG. 2) or the operator of the signaling device. At step 910, the signaling device transmits a signal which may be received by an electronic inflow control device, and which may include a command to adjust the flow resistance provided by the electronic inflow control device. As discussed above with respect to FIGS. 3 and 4, an electronic inflow control device may include a receiver operable to receive signals from a signaling device. The signals received by the electronic inflow control device may include commands to adjust the flow resistance provided by the electronic inflow control device. The signals may be transmitted to the receiver using any desirable method.

At step 920, the flow resistance provided by the electronic inflow control device may be adjusted. As discussed above in conjunction with FIGS. 3 and 4, the electronic inflow control device may include a flow regulator, which may be adjustable to provide varying degrees of flow resistance, and a controller, which may be communicatively coupled to the receiver and operable to control adjustment of the flow resistance provided by the flow regulator in response to signals received by the receiver. For example, when the receiver receives a signal from a signaling device to increase the flow resistance by a specified amount, the controller may actuate the flow regulator to increase the flow resistance provided by the flow regulator by the specified amount. Similarly, when the receiver receives a signal to adjust the flow resistance provided by the flow regulator to a particular value, to adjust the flow resistance provided by the flow regulator to a minimum (e.g., fully open the regulator), to adjust the flow resistance provided by the flow regulator to a maximum (e.g., fully close the regulator), or to perform any commands after a specified time delay, the controller may actuate the flow regulator to adjust the flow resistance provided by the flow regulator according to the command corresponding to the signal received by the receiver.

Optionally, at step 930, a determination may be made regarding whether to further adjust the flow resistance provided by the electronic inflow control device. If it is determined that the flow resistance provided by the electronic inflow control device should be further adjusted, the method may return to step 910. If it is determined that the flow resistance provided by the electronic inflow control device should not be further adjusted, the method 900 may end.

Modifications, additions, or omissions may be made to the method 900 without departing from the scope of the present disclosure. For example, the order of the steps may be performed in a different manner than that described, and some steps may be performed at the same time. Additionally, each individual step may include additional steps without departing from the scope of the present disclosure.

Well systems for use in subterranean formations are provided. An example well system comprises a water front sensor operable to sense a water front, wherein the water front sensor comprises a water front sensor signal transmitter and a water front sensor signal receiver. The example well system further comprises an electronic inflow control device, wherein the electronic inflow control device comprises a flow regulator in fluidic communication with an inlet of the electronic inflow control device and adjustable to provide a flow resistance to a fluid flowing through the electronic inflow control device, and a controller configured to actuate the flow regulator to change the flow resistance through the electronic inflow control device. The water front sensor may be operable to sense an approaching water front prior to the water front contacting the electronic inflow control device. The flow regulator may be operable to adjust the flow resistance prior to the water front contacting the electronic inflow control device. The water front sensor may be an electromagnetic sensor, wherein the water front sensor signal transmitter is operable to transmit electromagnetic waves, and wherein the water front sensor signal receiver is operable to measure the total electromagnetic field of a portion of the formation. The water front sensor may be a neutron logging sensor, wherein the water front sensor signal transmitter is operable to emit neutrons, and wherein the water front sensor signal receiver is operable to detect gamma rays. The electronic inflow control device may further comprise a generator in fluidic communication with the inlet that utilizes the fluid flowing through the electronic inflow control device to generate electrical power. The well system may further comprise a signaling device communicably coupled to the water front sensor, wherein the water front sensor is configured to signal the signaling device of a sensed water front. The electronic inflow control device may further comprise a receiver communicably coupled to the signaling device, wherein the receiver is configured to receive a signal from the signaling device of the sensed water front. The receiver may be communicably coupled to the controller and wherein the receiver is configured to signal the controller to actuate the flow regulator. The well system may further comprise non-electronic inflow control devices.

Another example well system for use in a subterranean formation is provided. The example well system comprises a first well, wherein the first well comprises a water front sensor operable to sense a water front, and an electronic inflow control device. The well system further comprises a second well adjacent to the first well. The first well may be a production well. The second well may be an injection well or a hydraulically fractured well. The water front sensor may be operable to sense a water front produced from the second well. The electronic inflow control device may be operable to restrict inflow of the water produced from the second well. The water front sensor may comprise a water front sensor signal transmitter and a water front sensor signal receiver. The electronic inflow control device may comprise a flow regulator in fluidic communication with an inlet of the electronic inflow control device and adjustable to provide a flow resistance to a fluid flowing through the electronic inflow control device, and a controller configured to actuate the flow regulator to change the flow resistance through the electronic inflow control device. The water front sensor may be operable to sense an approaching water front prior to the water front contacting the electronic inflow control device. The flow regulator may be operable to adjust the flow resistance prior to the water front contacting the electronic inflow control device. The water front sensor may be an electromagnetic sensor, wherein the water front sensor signal transmitter is operable to transmit electromagnetic waves, and wherein the water front sensor signal receiver is operable to measure the total electromagnetic field of a portion of the formation. The water front sensor may be a neutron logging sensor, wherein the water front sensor signal transmitter is operable to emit neutrons, and wherein the water front sensor signal receiver is operable to detect gamma rays. The electronic inflow control device may further comprise a generator in fluidic communication with the inlet that utilizes the fluid flowing through the electronic inflow control device to generate electrical power. The well system may further comprise a signaling device communicably coupled to the water front sensor, wherein the water front sensor is configured to signal the signaling device of a sensed water front. The electronic inflow control device may further comprise a receiver communicably coupled to the signaling device, wherein the receiver is configured to receive a signal from the signaling device of the sensed water front. The receiver may be communicably coupled to the controller and wherein the receiver is configured to signal the controller to actuate the flow regulator. The well system may further comprise non-electronic inflow control devices.

Methods of adjusting flow resistance in an electronic inflow control device within a wellbore are provided. An example method comprises sensing an approaching water front in a subterranean formation surrounding the wellbore with a water front sensor positioned within the wellbore, and actuating a flow regulator within the electronic inflow control device. The approaching water front may contact the electronic inflow control device, and the flow regulator may be actuated before the said approaching water front contacts the electronic inflow control device. The water front sensor may be an electromagnetic sensor, and wherein the sensing an approaching water front may comprise transmitting electromagnetic waves and measuring the total electromagnetic field of a portion of the formation. The water front sensor may be a neutron logging sensor, and the sensing an approaching water front may comprise emitting neutrons and detecting gamma rays. The approaching water front may be produced from an adjacent injection well. The water front sensor may comprise a water front sensor signal transmitter and a water front sensor signal receiver. The electronic inflow control device may comprise a flow regulator in fluidic communication with an inlet of the electronic inflow control device and adjustable to provide a flow resistance to a fluid flowing through the electronic inflow control device, and a controller configured to actuate the flow regulator to change the flow resistance through the electronic inflow control device. The electronic inflow control device may further comprise a generator in fluidic communication with the inlet that utilizes the fluid flowing through the electronic inflow control device to generate electrical power. The method may further comprise a signaling device communicably coupled to the water front sensor, wherein the water front sensor is configured to signal the signaling device of a sensed water front. The electronic inflow control device may further comprise a receiver communicably coupled to the signaling device, wherein the receiver is configured to receive a signal from the signaling device of the sensed water front. The receiver may be communicably coupled to the controller and wherein the receiver is configured to signal the controller to actuate the flow regulator. The well system may further comprise non-electronic inflow control devices.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative embodiments disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A well system in a subterranean formation, comprising:

a water front sensor operable to sense a water front, wherein the water front sensor is a neutron logging sensor, wherein the water front sensor further comprises:

a water front sensor signal transmitter operable to emit neutrons, and a water front sensor signal receiver operable to detect gamma rays; and an electronic inflow control device, wherein the electronic inflow control device comprises:

a flow regulator in fluidic communication with an inlet of the electronic inflow control device and adjustable to provide a flow resistance to a fluid flowing through the electronic inflow control device, a controller configured to actuate the flow regulator to change the flow resistance through the electronic inflow control device, and a generator in fluidic communication with the inlet that utilizes the fluid flowing through the electronic inflow control device to generate electrical power, wherein the generator and the flow regulator are in series such that fluid does not flow through the generator when the flow regulator is closed.

2. The well system of claim 1, wherein the water front sensor is operable to sense an approaching water front prior to the water front contacting the electronic inflow control device.

3. The well system of claim 1, wherein the flow regulator is operable to adjust the flow resistance prior to the water front contacting the electronic inflow control device.

4. The well system of claim 1, further comprising a second water front sensor that is an electromagnetic sensor comprising a second water front sensor signal transmitter operable to transmit electromagnetic waves, and a second water front sensor signal receiver operable to measure the total electromagnetic field of a portion of the formation.

5. The well system of claim 1 further comprising a signaling device communicably coupled to the water front sensor, wherein the water front sensor is configured to signal the signaling device of a sensed water front.

6. The well system of claim 5, wherein the electronic inflow control device further comprises a receiver communicably coupled to the signaling device, wherein the receiver is configured to receive a signal from the signaling device of the sensed water front.

7. The well system of claim 6, wherein the receiver is communicably coupled to the controller and wherein the receiver is configured to signal the controller to actuate the flow regulator.

8. The well system of claim 1, wherein the well system further comprises non-electronic inflow control devices.

9. A well system in a subterranean formation, comprising:

a first well, wherein the first well comprises:

a water front sensor operable to sense a water front, wherein the water front sensor is a neutron logging sensor, and an electronic inflow control device comprising a generator in fluidic communication with an inlet of the electronic inflow control device such that the fluid flowing through the electronic inflow control device generates electrical power, wherein the generator is in series with a flow regulator such that fluid does not flow through the generator when the flow regulator is closed;

wherein the flow regulator is operable to restrict inflow when the water front is sensed by the water front sensor;

a second well adjacent to the first well.

10. The well system of claim 9, wherein the first well is a production well.

11. The well system of claim 9, wherein the second well is an injection well or a hydraulically fractured well.

12. The well system of claim 9, wherein the water front sensor is operable to sense a water front produced from the second well.

13. The well system of claim 9, wherein the electronic inflow control device is operable to restrict inflow of the water produced from the second well.

14. A method of adjusting flow resistance in an electronic inflow control device within a wellbore, the method comprising:

sensing an approaching water front in a subterranean formation surrounding the wellbore with a water front sensor positioned within the wellbore, wherein the sensing is performed with a neutron logging sensor; and actuating a flow regulator within the electronic inflow control device;

generating electrical power with a generator in fluidic communication with an inlet of the electronic inflow control device; wherein the generator is in series with the flow regulator such that fluid does not flow through the generator when the flow regulator is actuated to be closed.

15. The method of claim 14, wherein the approaching water front contacts the electronic inflow control device, and wherein the flow regulator is actuated before the approaching water front contacts the electronic inflow control device.

16. The method of claim 14, further comprising a second water front sensor that is an electromagnetic sensor, and wherein the sensing an approaching water front comprises transmitting electromagnetic waves and measuring the total electromagnetic field of a portion of the formation.

17. The method of claim 14, wherein the sensing an approaching water front comprises emitting neutrons and detecting gamma rays.

18. The method of claim 14, wherein the approaching water front is produced from an adjacent injection well.

* * * * *